United States Patent [19]

Raybuck

[11] Patent Number: 4,941,650

[45] Date of Patent: Jul. 17, 1990

[54] VACUUM COUNTER FOR STACKED SIGNATURES

[75] Inventor: William Raybuck, Rockledge, Fla.

[73] Assignee: Stacker Machine Co., Inc., Mountainside, N.J.

[21] Appl. No.: 373,695

[22] Filed: Jun. 28, 1989

Related U.S. Application Data

[63] Continuation of Ser. No. 151,006, Feb. 1, 1988, abandoned.

[51] Int. Cl.[5] ..... B65H 33/04

[52] U.S. Cl. ..... 270/95; 414/901; 271/176; 271/216; 271/286; 270/54; 198/418.8

[58] Field of Search ..... 270/52, 58, 59, 95; 414/54, 103, 901; 271/176, 183, 216, 285, 286, 207, 237

[56] References Cited

U.S. PATENT DOCUMENTS

| | | | |
|---|---|---|---|
| 2,114,927 | 4/1938 | Krell | 271/207 |
| 3,691,915 | 9/1972 | Kiela et al. | 414/901 |
| 3,698,709 | 10/1972 | Heal et al. | 414/54 |
| 4,060,237 | 11/1977 | Degen et al. | 271/237 |
| 4,730,822 | 3/1988 | Wagner | 270/95 |

FOREIGN PATENT DOCUMENTS

| | | | |
|---|---|---|---|
| 59-128157 | 7/1984 | Japan | 271/286 |
| 2055353 | 3/1981 | United Kingdom | 271/237 |

*Primary Examiner*—Robert E. Garrett
*Assistant Examiner*—Therese M. Newholm
*Attorney, Agent, or Firm*—Mathews, Woodbridge & Collins

[57] ABSTRACT

An apparatus for forming an indicium in a stream of moving signatures, consisting of a signature displaced laterally from the stream and corresponding to a predetermined count of signatures, comprises an idler roller mechanism connected with a rotatable idler roller shaft and a series of vacuum heads located adjacent to and downstream of the idler roller mechanism. The vacuum heads are mounted to a vacuum head shaft laterally movable with respect to the signatures. A detector such as a laser detector coupled with a counter is used to actuate the system. When a predetermined count is reached as determined by the detector and counter, the idler roller shaft is caused to rotate to lower the idler roller and the signature corresponding to the count contacts the tops of each vacuum head. Simultaneously, a partial vacuum is formed in the recessed vacuum chamber of each head binding the targeted signature to the heads. The vacuum head shaft is then moved laterally to displace the held signature a short distance to form a tab.

7 Claims, 4 Drawing Sheets

VACUUM COUNTER FOR STACKED SIGNATURES

This is a continuation of application Ser. No. 151,006 filed Feb. 1, 1988, now abandoned.

BACKGROUND OF THE INVENTION

This invention relates to the field of counting stacked signatures from the end of a printing press prior to bundling. More particularly the invention relates to an apparatus used in conjunction with a detector and a counter for such signatures which provides an indicium to the operator of a stacking machine as to when a predetermined count of signatures has ocurred.

Signature stackers are used to convey paper signatures from the fly end of a printing press to a receiving station where they are stacked, and later compressed and bundled for shipment. U.S. Pat. No. 4,463,940 describes such a stacker which includes an in-feed conveyor containing a conveyor jogger which initially carries a stream of shingled signatures from the press. The signatures are then conveyed to a pair of crusher rollers to remove air therefrom and then to a compression zone consisting of a pair of floating conveyor timing belts and a series of compression rollers in which the signatures are conveyed between the timing belts in an upward arch. Leaving the compression zone the stream of signatures having upward thrust are kicked, stopped, simultaneously engaged and jogged in a vertical stacking mode at a receiving station. Thereafter, the signatures are removed to a bundling station where they are compressed and bundled.

In most instances it is necessary to obtain a count of the stacked signatures prior to bundling. This can be achieved manually or by using a detector which detects the heads of each signature and a counter which determines the signature count. However, even using these devices the operator must still find that signature which corresponds to the predetermined count. Such target signature is located at the position of the detector which may be located at any position along the signature stream so that the problem becomes one of accurate determination and selection.

The present invention, on the other hand, provides an apparatus located in the in-feed conveyor of a stacker and used in conjunction with a detector-counter which provides an indicium to the operator at the receiving station as to when the predetermined count is reached. The indicium consists of a tab formed by an outwardly moved signature in the stream corresponding to the count and the apparatus of the invention accomplishes this function.

SUMMARY OF THE INVENTION

In brief, the present invention provides an apparatus for forming an indicium in a stream of moving signatures, the indicium consisting of a signature displaced laterally from the stream and corresponding to a predetermined count of signatures. The apparatus can be located in the in-feed conveyor of a stacking machine as hereinbefore described and comprises an idler roller mechanism connected with a rotatable idler roller shaft which roller supports the signatures and a series of vacuum heads located adjacent to and downstream of the idler roller mechanism, which vacuum heads are mounted to a vacuum head shaft laterally movable with respect to the signatures. The vacuum heads each have a top in which there is provided a recessed vacuum chamber and the heads are located between the belts of the in-feed conveyor but do not support any signatures in their unactuated condition. The system is pneumatically controlled using air cylinders as the actuating means for rotating the idler roller shaft and vacuum head shaft. Compressed air is also supplied to the vacuum heads. Automatic control is achieved by a system of solenoid valves connected with the compressed air system. A detector such as a laser detector coupled with a counter is used to actuate the system.

In use, when a count is reached as determined by the detector and counter, the idler roller shaft is caused to rotate to lower the idler roller and the signature corresponding to the count contacts the tops of each vacuum head. Simultaneously, a partial vacuum is formed in the recessed vacuum chamber of each head binding the targeted signature to the heads. The vacuum head shaft is then moved laterally to displace the held signature a short distance so that it protrudes outwardly from the stream to form a tab. Thereafter the vacuum in the vacuum head is halted, the vacuum head shaft returns to its non-actuated position and the idler roller shaft is caused to rotate to a position wherein the idler roller again supports the signatures.

DETAILED DESCRIPTION OF THE PREFERRED EMBODIMENTS

Figure 1:
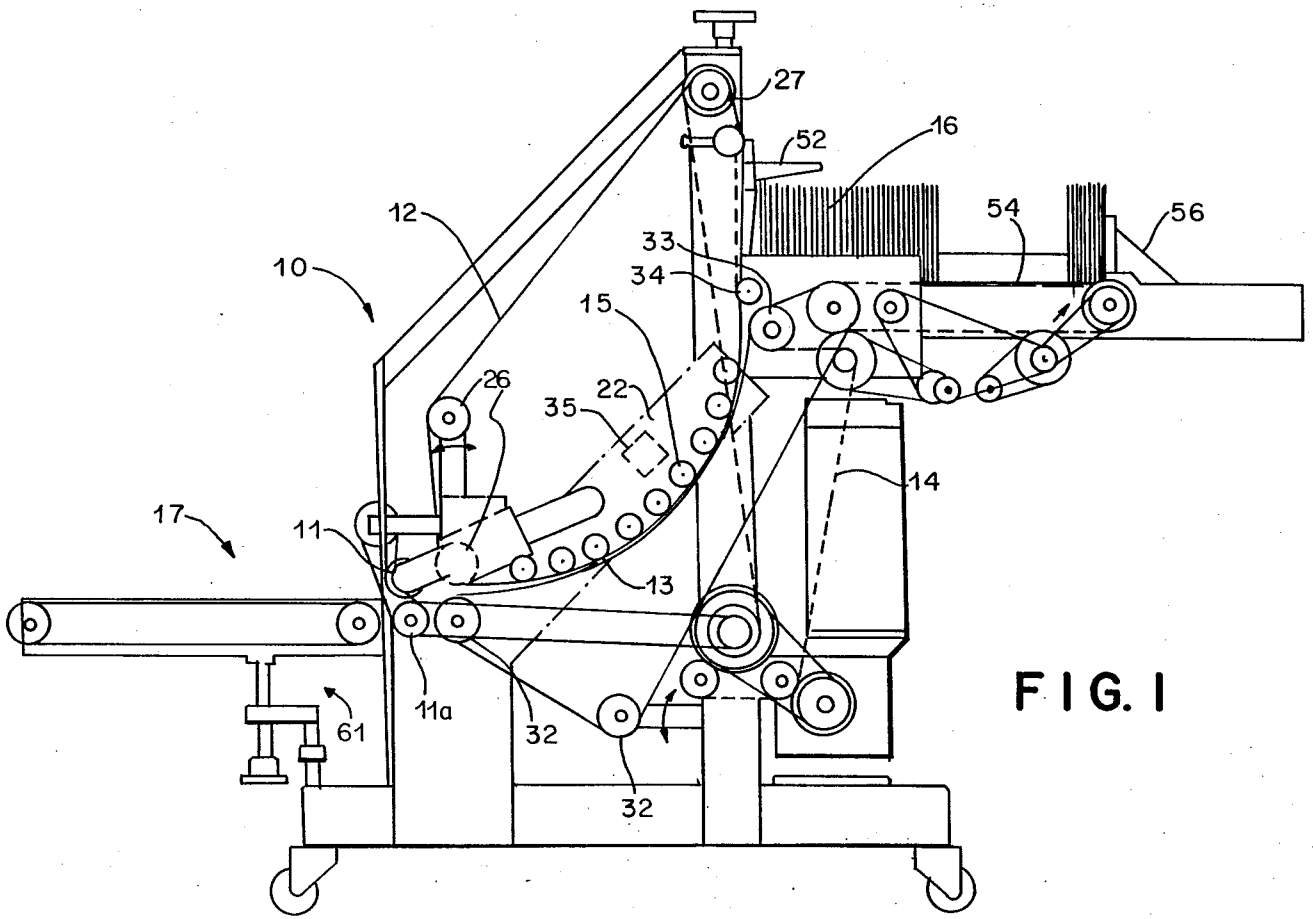
FIG. 1 shows a side view of an apparatus for the continuous stacking of signatures.

FIG. 1 shows an apparatus for continuous stacking of signatures using opposed floating conveyors as described in U.S. Pat. No. 4,463,940.

The signature stacker 10 is adapted to continued signature flow from the fly end of a given press. The stacker's components include in-feed conveyor 17, tension mounted crusher rollers **11–11*a*, coactive floating conveyor timing belts 12–13, constant speed control chain 14 for the timing belts, compressor rollers 15 and receiver 16. The apparatus may also include an input conveyor-jogger (not shown) on in-feed conveyor 17. The crusher rollers 11–11*a* may also be located upstream of the conveyor jogger at the front of the in-feed conveyor. In general, folded, overlapped signatures exiting from the fly end of a press are stream conveyed, while channelized along the initial horizontal course on the in-feed conveyor, precedent to vertical transition. They are initially crushed between rollers 11 and 11*a* to exhaust air and compact them. The stream of shingled or lapped signatures is passed thereafter between topmost and lowermost conveyors which are adapted to maintain a fully compressed state in the signatures during their transition from horizontal conveyance to vertical receiving station. To ensure correlative constant speed between the respective transition crushers and conveyors, a speed control chain 14 is interconnected with the respective driven rollers. Leaving the compression zone the stream of signatures having upward thrust is kicked and stopped and simultaneously engaged and jogged in the vertical stacking mode at the receiver 16**.

As indicated, the principal function of the stacker 10 is to facilitate handling of folded, printed paper media which is delivered from a web offset press in the forms of either chop, double parallel or tabloid. The stacker 10 being portable is placed in-line with a printing press or combination folder, or plow folding station wherein the flow of the folded signatures is sustained in a stream. This stream moves continuously from the press, folder or plow, into and out of the stacker for palletizing or bundling of the product. The folded signatures are moved through the stacker in a shingled stream. By design modification, the stacker is capable of accomodating plural streams of such signatures. As the flow of folded paper media continues into and out of the stacker conveyors they are receiver stacked, in this instance vertically. Simultaneously the stacked product from the receiver is shuttled to a bundler station.

As the signatures travel through the stacker, they are compression engaged by superposed floating conveyors 12 and 13, each held arcuately by nine series-disposed crusher rollers 15 and plates 22. Both conveyors 12 and 13 each comprise four endless timing belts, laterally spaced a few inches apart from one another. They are tensioned by means of pulleys 26 and 32. Each belt of the conveyor 12 and 13 moves, as do the crusher rollers, at a constant relative speed, the speed control of which is obtained through engagement of drive chain 14 with sprockets of the conveyors, viz: 27, 33 and kicker 34. Leaving the compression zone defined by journal plate 22 and rollers 15, the signatures have now essentially completed the transition from horizontal position to vertical. At this juncture, the signatures will be individually engaged by two centrally disposed, spaced kicker wheels 34, the same being centrally mounted upon a needle bearing above the belts of conveyor 13.

Each signature, being kicked upwardly strikes an adjustable receiver tripper bar 52 and is displaced sidewise from the tripper bar by a following signature, to be subsequently engaged by delivery table conveyor belts 54, all while in a vertically aligned upstanding position. Each new stack is movement controlled by the imposition of a slidable product engaging backstop 56, which is placed to engage the stacked product as it moves along the belts 54.

It is advantageous, and sometimes necessary, prior to bundling the stacked signatures from the receiver 16 to count the signatures so that the stack contains a predetermined number of signatures, e.g. 100. This can be accomplished by using known detectors for signatures such as laser, optical or mechanical detectors located at some point along the stream. For example, a laser detector 35 can be mounted between plates 22 directed downwardly at the signatures above compressed rollers 15. The detector 35 is then connected to a counting device and as the head or leading edge of each shingled signature is detected it is counted by the counting device. Such counters are well known in the art.

Figure 2:
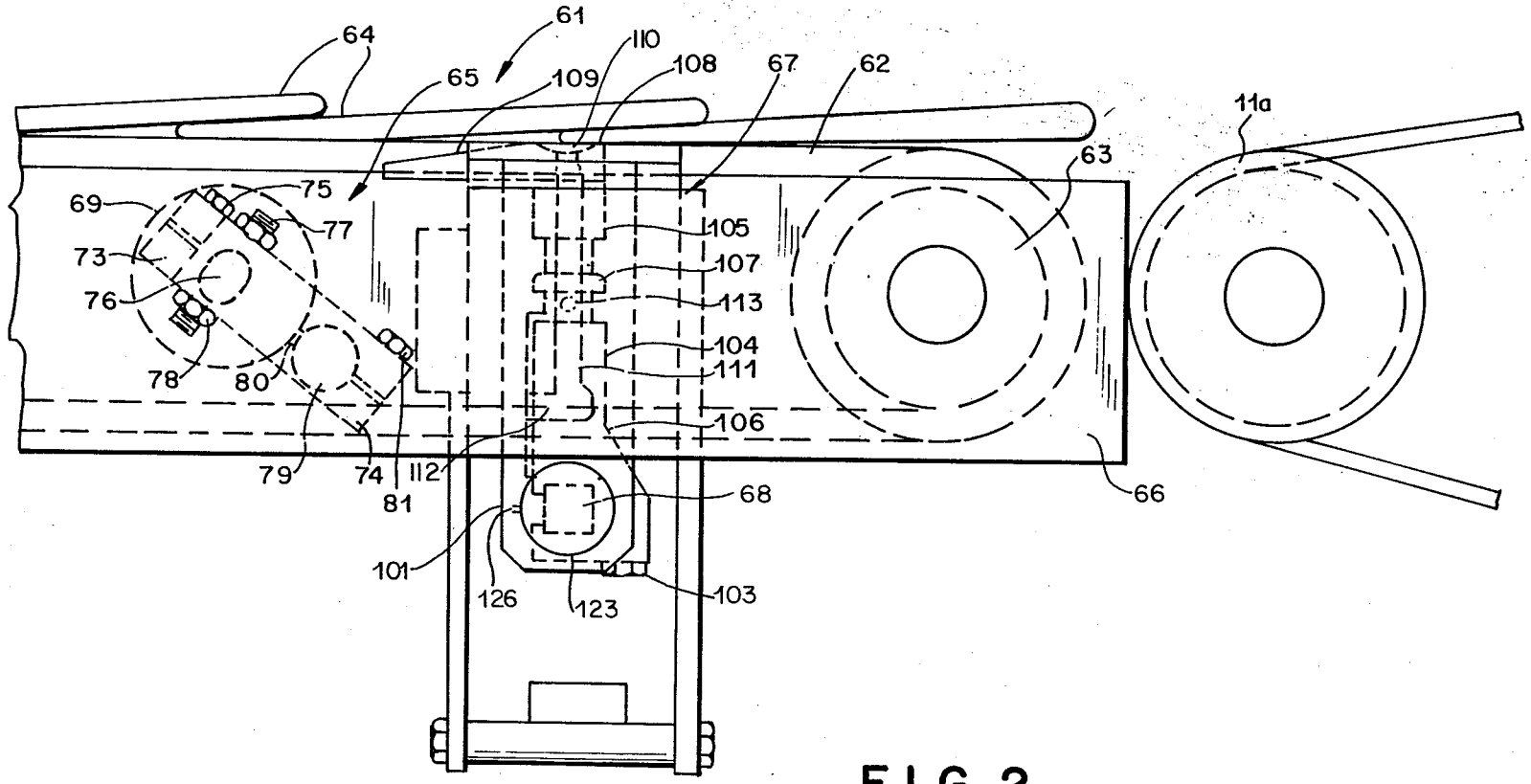
FIG. 2 is a side view of an in-feed conveyor or as shown in FIG. 1 including the apparatus of the invention.

The present invention shown generally by 61 in FIGS. 1 and 2 and accompanying connecting apparatus goes a step beyond mere counting by providing an indicium to the operator as to when the signature count has been reached which will be reflected at the receiving station 16. This indicium consists of a tab in the signature stacker displaced outwardly (horizontally) of the stack, the tab being a signature so displaced corresponding to the predetermined number counted. Thus if the count is 100, for example, the apparatus of the invention will displace outwardly from the stack stream the 100th signature which can be readily viewed by the operator at the receiving station 16.

The apparatus is located in the in-feed conveyor 17 as shown in FIG. 2. FIG. 2 shows one of the in-feed conveyor rollers 63 (the other shown in FIG. 1) and one of five endless belts 62 which support a stream of signatures 64. The conveyor is supported on frame members 66. The apparatus consists of two cooperating units, a tilting idler roller mechanism 65 and a vacuum head system 67, both of which are pneumatically controlled. The vacuum heads are mounted on a horizontally movable shaft 68, each head located between a pair of belts 62 (two shown in FIG. 3).

Figures 3, 4:
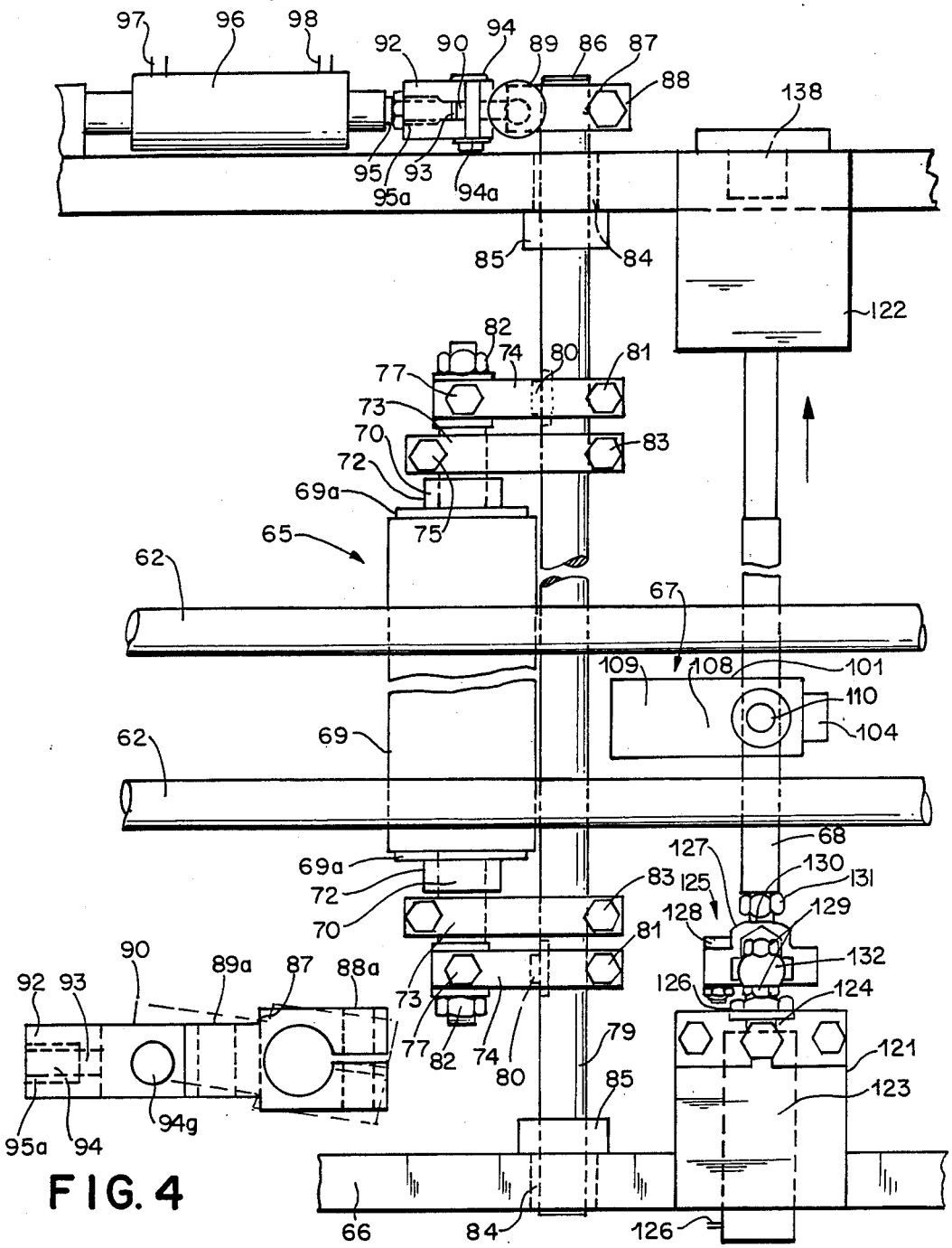
FIG. 3 is a top view of the apparatus of the invention.
FIG. 4 is a side view of the linkage between the idler roller shaft and the air cylinder actuator for said shaft.

Referring to FIGS. 2 and 3, the tilting idler roller mechanism 65 comprises an idler roller 69 having hubs **69*a* mounted on shaft 70. A rotatable idler roller shaft 79 is mounted between frames 66 adjacent the idler roller. In the unactuated position the idler roller 69 supports the conveyor belts 62 of the in-feed conveyor as shown in FIG. 2 The idler roller rotates about an idler shaft 70 journalled on bearings 72. Each end of idler shaft 70 passes through split bracket arm 73 and adjusting bracket arm 74. Shaft 70 is secured to bracket arm 73 by means of hex nut 75 and bracket arm 73 is secured to shaft 79 by hex nut 83. Support bracket arm 74 accomodates shaft 70 and contains adjustment slot 76 into which can be threaded adjusting nuts 77 and 78. Adjustable bracket 74 is secured to shaft 79 by means of keyway 80 and nut 81**.

The shaft 70 is secured at both ends by nuts 82. By adjusting bracket arm 74 along the keyway 80 and/or adjusting nuts 77 and 78 the idler roller orientation may be adjusted vertically and/or horizontally.

The shaft 79 is rotatably secured to frame 66 by means of bushings 84 and screw collars 85. The shaft 79 at one end thereof, extends outside the frame 66 at 86. Referring additionally to FIG. 4, there is mounted on such shaft end a shaft bracket 87 secured by nut 88. On the side of the shaft opposite nut 88 is steel core bumper 89. The bracket has a bracket extension 90 having a hole 91. An air cylinder extension 92 having a slot 93 for pivotably receiving the bracket extension 90 and a hole matable with hole 91 is connected to extension 90 by means of pin 94 and cotter pin **94*a*. Reference numerals 88*a*, 89*a* and 94*b* in FIG. 4 show the receiving bores or holes wherein nut 88, bumper 89 and pin 94, respectively are received. The outer end of air cylinder extension 92 contains a threaded bore 95*a* through which is threaded the shaft 95 of double acting air cylinder 96 mounted on frame 66. The air cylinder has air inlets 97 and 98**.

When air is admitted to cylinder 96 through inlet 97 the shaft 95 is caused to move to the right pivoting extension 90 upwardly on pin 94, the movement being limited by the bumper 89 against extension 92, thus, causing the shaft 79 to move clockwise and the idler roller 69 to rise. (Shown in dotted lines in FIG. 4). Conversely when air is admitted to inlet 98 the shaft of the air cylinder is caused to move to the left moving shaft 79 counterclockwise and lowering the idler roller 69.

Referring now to the vacuum head mechanism 67 in FIGS. 2 and 3, a series of vacuum head units 101 are mounted on shaft 68 which is in turn laterally or horizontally movably mounted between frames 66. In general there are four vacuum head units 101 for a five (5) belt in-feed conveyor system, with each head being located between a pair of belts. FIG. 3 shows a pair of belts having one vacuum head mounted therebetween. Each head is mounted to shaft 68 by means of bolts 103. The head comprises a body 104 having an upper section 105 and lower section 106 connected by nut 107. The top portion has a flat top 108 which slants downward rearwardly at 109 to prevent signatures from snagging on the top. A small circular recess is formed on the top providing a vacuum chamber 110. A vertical chamber 111 is also formed in the upper and lower sections 105 and 106 which communicates with vacuum chamber 110 and an air inlet 112. An air outlet consisting of four (4) circumferential holes 113 (one shown in FIG. 2) also communicates with vertical chamber 111.

Operation of the vacuum heads 101 is as follows. Air under pressure entering air inlet 112 is forced through vertical chamber 111 and passes through air outlet 113. This causes a pressure drop or partial vacuum in the vertical air chamber above the air outlet and thus in circular vacuum chamber 110. Any signature which is in contact with the top 108 of a vacuum head 101 will be held by the vacuum created in each circular vacuum chamber.

Shaft 68 is connected between shaft housings 121 and 122 and is laterally movable therebetween in the direction shown by the arrows in FIG. 3. Housing 121 has mounted therein single acting spring-biased air cylinder 123 having shaft 124 and air inlet 126 Cylinder 23 is biased in the direction opposite to the direction of intended movement of the shaft 68. Jam nut 126 is secured to the end of shaft 124 at the housing 121. Between the end of shaft 24 and shaft 68 is a spherical bearing assembly shown generally by 125 which comprises a housing 127 secured by nut and bolt 128 and containing spherical bearing 132 having opposed jam nuts 129. Another such spherical bearing is mounted at the opposite end of shaft 68 in housing 122 (not shown). The spherical bearing permits the shaft 68 to be misaligned without bending. Also located in housing 122 is bumper 138 which limits the lateral movement of the shaft. A connector 130 on the spherical bearing assembly is secured to shaft 68 by nut 131. When air is admitted to air cylinder 123 the cylinder shaft 124 moves outwardly against spherical bearing 132 and this force is imparted to shaft 130 and moves the shaft in the direction of the arrow in FIG. 3 against bumper 138. When air pressure is released the shaft 68 returns to its original position by virtue of the spring loading of the air cylinder 123.

In general, operation of the invention is as follows.

In response to the output of a detector such as a laser detector in conjunction with a counter whose count of signatures is predetermined, compressed air is simultaneously admitted to the air inlet 112 of the vacuum heads 101, the air inlet 126 of the vacuum head shaft cylinder 123 and air inlet 98 of the idler cylinder 96. Simultaneously this causes shaft 79 to rotate counterclockwise lowering idler roller 69 and to create a vacuum at the circular vacuum chambers 110 of each vacuum head 101 and to move shaft 68 laterally. In the course of these operations the belts 62 supporting the signatures 64 drop below the tops 108 of the vacuum heads 101 and the target signature corresponding to the predetermined count is held on the top of the vacuum heads by the vacuum created in chambers 110 and then such signature is shifted a short distance laterally with respect to the stream by the movement of shaft 68 to form a tab which can be recognized by the operator. Air flow is then halted to the vacuum heads and the air inlet of the vacuum head shaft wherein the target signature is released and the shaft returns to its starting position by virtue of the spring biased cylinder. Air is then admitted to inlet 97 of cylinder 96 to turn shaft 79 clockwise and raise idler roller 69 under belts 62 to again support the moving signatures.

Figure 5:
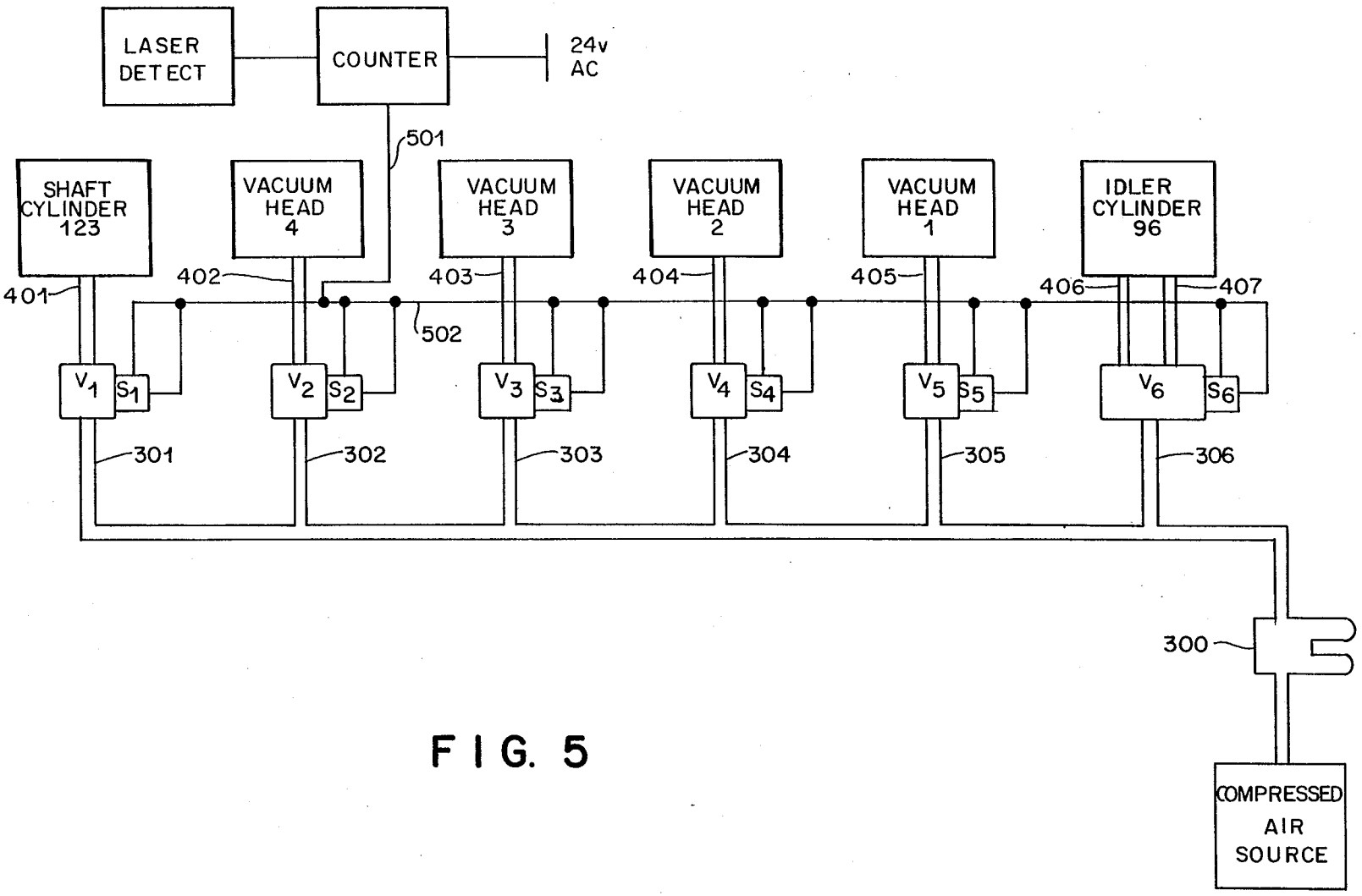
FIG. 5 is a block diagram of a compressed air system and automatic acutating system for the apparatus of the invention.

FIG. 5 shows a block diagram of an automatic system for accomplishing the above operation employing a source of compressed air and solenoid valves. Air from a COMPRESSED AIR SOURCE is passed to regulator 300 to maintain constant air pressure and then introduced to valves $V_1$ to $V_6$ via lines 301 to 306 which valves are controlled by solenoids $S_1$ to $S_6$, respectively. The valves are connected by compressed air line 401 from valve $V_1$ to the inlet 126 of shaft cylinder 123, by lines 402 to 405 from valves $V_2$ to $V_5$ to the inlets 112 of the four vacuum heads 101 (1 to 4) and by lines 406 and 407 from valve $V_6$ to inlets 98 and 97 of idler cylinder 96, respectively. The laser detector 35 shown in FIG. 1 is connected to a counter such as a CompuCount I Batch Counter (D&R Eng., Hawthorne, Calif.) which is in turn connected to a 24v AC power source. The counter is electrically connected to solenoids $S_1$ to $S_6$ through main line 501 and branch lines 502.

When a predetermined count is reached as determined by the laser detector and counter, solenoids $S_1$ to $S_6$ open valves $V_1$ to $V_6$ to admit compressed air to the shaft cylinder, vacuum heads and to inlet 98 of idler cylinder 96 to effect operation of the apparatus as described above. After actuation solenoids $S_1$ to $S_5$ close to bring the shaft cylinder back to its start position and cease the vacuum in the vacuum heads. Solenoid $S_6$ acts to admit air to inlet 97 of the idler cylinder to again raise the idler roller.

I claim:

1. An apparatus for forming an indicium in a stream of continuously moving shingled signatures, said indicium consisting of a signature displaced laterally from said stream comprising:

a frame;

a vacuum head shaft mounted in said frame and being laterally movable in said frame;

means for laterally moving said vacuum head shaft; and at least one vacuum head mounted on said vacuum head shaft below said signatures, said vacuum head having a body and a top, said top having a recessed vacuum chamber, whereby a vacuum is formed in said recessed chamber to hold said signature on said top of said vacuum head and said vacuum head shaft is moved laterally by said means for moving said vacuum head causing said signature indicium to move laterially of said moving signature stream.

2. An apparatus for forming an indicium in a stream of continuously moving shingled signatures, said indicium consisting of a signature displaced laterally from said stream comprising:

(a) a frame;

(b) an idler roller shaft rotatably mounted in said frame;

(c) an idler roller connected to said idler roller shaft and supporting said signatures;

(d) means for rotating said idler roller shaft;

(e) a vacuum head shaft mounted in said frame adjacent to said idler roller shaft and being laterally movable in said frame;

(f) means for laterally moving said vacuum head shaft; and (g) at least one vacuum head mounted on said vacuum head shaft below said signatures, said vacuum head having a body and a top, said top having a recessed vacuum chamber, an inlet and an outlet for compressed air, a central chamber communicating with said inlet, said outlet and said recessed vacuum chamber, whereby said means for rotating said idler roller shaft is actuated to lower said idler roller and place a signature indicium on said top of said vacuum head, and a vacuum is formed in said recessed chamber to hold said signature on said top of said vacuum head and said vacuum head shaft is moved laterally by said means for moving said vacuum head causing said signature indicium to move laterally of said moving signature stream.

3. The apparatus of claim 2 wherein said means for rotating said idler roller shaft is a double acting compressed air cylinder.

4. The apparatus of claim 2 wherein said means for laterally moving said vacuum head shaft is a compressed air cylinder.

5. The apparatus of claim 4 wherein said compressed air cylinder is spring biased.

6. The apparatus of claim 2 wherein said idler roller is connected to said idler roller shaft by a first arm bracket.

7. The apparatus of claim 2 wherein said idler roller is further connected to said idler roller shaft by a second adjustable arm bracket, said bracket containing an adjustable slot and being keyed into said idler roller shaft.

* * * * *